United States Patent [19]

Gordemer et al.

[11] 4,219,288

[45] Aug. 26, 1980

[54] WEB FORMER HAVING STOP MOTION CONTROL

[75] Inventors: David Gordemer, Charlotte, N.C.; Sao H. Seing, Duluth, Ga.

[73] Assignee: Fiber Controls Corporation, Gastonia, N.C.

[21] Appl. No.: 888,391

[22] Filed: Mar. 20, 1978

[51] Int. Cl.[2] ..... B65G 53/66

[52] U.S. Cl. ..... 406/28; 250/231 SE; 318/480

[58] Field of Search ..... 406/28, 34, 70, 168, 406/171, 198; 222/63; 19/105; 318/480; 250/231 SE, 548

[56] References Cited

U.S. PATENT DOCUMENTS

| | | | |
|---|---|---|---|
| 3,725,665 | 4/1973 | Talmo | 250/231 SE X |
| 3,814,934 | 6/1974 | Mesh et al. | 250/231 SE |
| 3,845,375 | 10/1974 | Stiebel | 318/480 X |
| 3,963,919 | 6/1976 | Sells | 250/231 SE |
| 4,154,485 | 5/1979 | Lytton et al. | 406/70 |

*Primary Examiner*—James L. Rowland

*Attorney, Agent, or Firm*—Cushman, Darby & Cushman

[57] ABSTRACT

A web former for a textile card or the like in which fibers in an air stream are delivered into a housing divided by a perforated plate into two chambers. The fibers fall to the bottom of one chamber and are formed into a web by three rollers. The plate is shaken by a motor to avoid build-up of fibers at the perforations and ensure that the fibers fall. A disc having sixty radial black bars is mounted for rotation on one roller to periodically interrupt the path between a light source and phototransistor to produce a pulse train which is applied to a counter and a monostable multi-vibrator. A logic flip-flop connects the counter and multivibrator to a relay controlling the shaker motor for delaying turning on the motor until the counter reaches a predetermined count but turning off the motor when the multivibrator times out.

8 Claims, 5 Drawing Figures

WEB FORMER HAVING STOP MOTION CONTROL

BACKGROUND AND SUMMARY OF THE INVENTION

The invention relates to an improvement in a web former for a card or the like which produces a bat of textile fibers for the card.

In fiber blending systems and the like, textile fibers such as cotton and synthetic fibers are processed and pneumatically or otherwise supplied to a line of card machines. Each of these card machines has associated therewith a web former which forms the pneumatically fed fibers into a bat which is then supplied to the card and processed thereby. The web former may include within an interior chamber a shaker plate, e.g., as described in U.S. Pat. No. 4,009,803 and other patents. This shaker plate is oscillated by a motor to shake the fibers into an area in the bottom of the chamber from which they are pulled by rollers which form the fibers into a bat.

Should the card machine malfunction or cease operating for any reason, it is desirable that the shaker motor be immediately shut off. In the past, this has been done by providing a "knock-off" control which connects to the card by electrical, mechanical, or pneumatic means to provide a signal rendering the shaker motor inoperative when the card stops operation. On the other hand, it is desirable to delay shaking for a short time after start-up of the web former.

There are substantial disadvantages, however, in providing a mechanical, electrical, or other connection between the card and the shaker motor. Since the rollers which form the bat are controlled by the card and stopped when the card stops, the movement of these rollers can be sensed and the shaker motor turned off whenever motion of the three rollers ceases. The difficulty is that the rollers turn slowly, and it is difficult to get a reliable signal at slow speeds using conventional techniques such as magnets mounted on a gear. Because of the low speed, the magnetic signals produced are weak and the noise/signal ratio too large to provide reliable operation. Adjustments with magnetic devices are difficult and adjustments in the field are complicated.

Applicants, however, have discovered that the above problem can be resolved by optically encoding the rotation and in particular sticking a photographic negative having black bars (preferably 60 bars per revolution) on a clear, light transmitting plastic disc which rotates with any one of the rollers and detecting light which passes through the disc or is reflected therefrom. Such optical devices are usually found in high-speed high-frequency applications. In the present situation, however, such an encoder provides a suitable signal having a very low noise/signal ratio, the signal being a train of pulses.

The output of this encoder is applied to a circuit discussed in detail below. The pulses from the encoder set a one-shot multivibrator which times out after a predetermined time interval, e.g., 8 seconds, to reset a relay latch which renders inoperative a coil controlling the magnetics of the shaker motor to disable the same. When the rollers resume rotation, producing pulses, the pulses are counted by a counter circuit to set the latch and cause resumption of the operation of the shaker motor only after a predetermined delay. As noted above, it is desirable under certain circumstances to delay operation of the shaker until a certain amount of material has moved through the system.

Other objects and purposes of the invention will be clear from the following detailed description of the drawings.

BRIEF DESCRIPTION OF THE DRAWINGS

FIG. 1 shows a perspective view of a system for feeding fibers to a plurality of conventional cards or the like;

FIGS. 3*a* and 3*b* show a detailed schematic of the circuit of the present invention for controlling operation of the shaker oscillator motor;

DETAILED DESCRIPTION OF THE DRAWINGS

Figure 1:
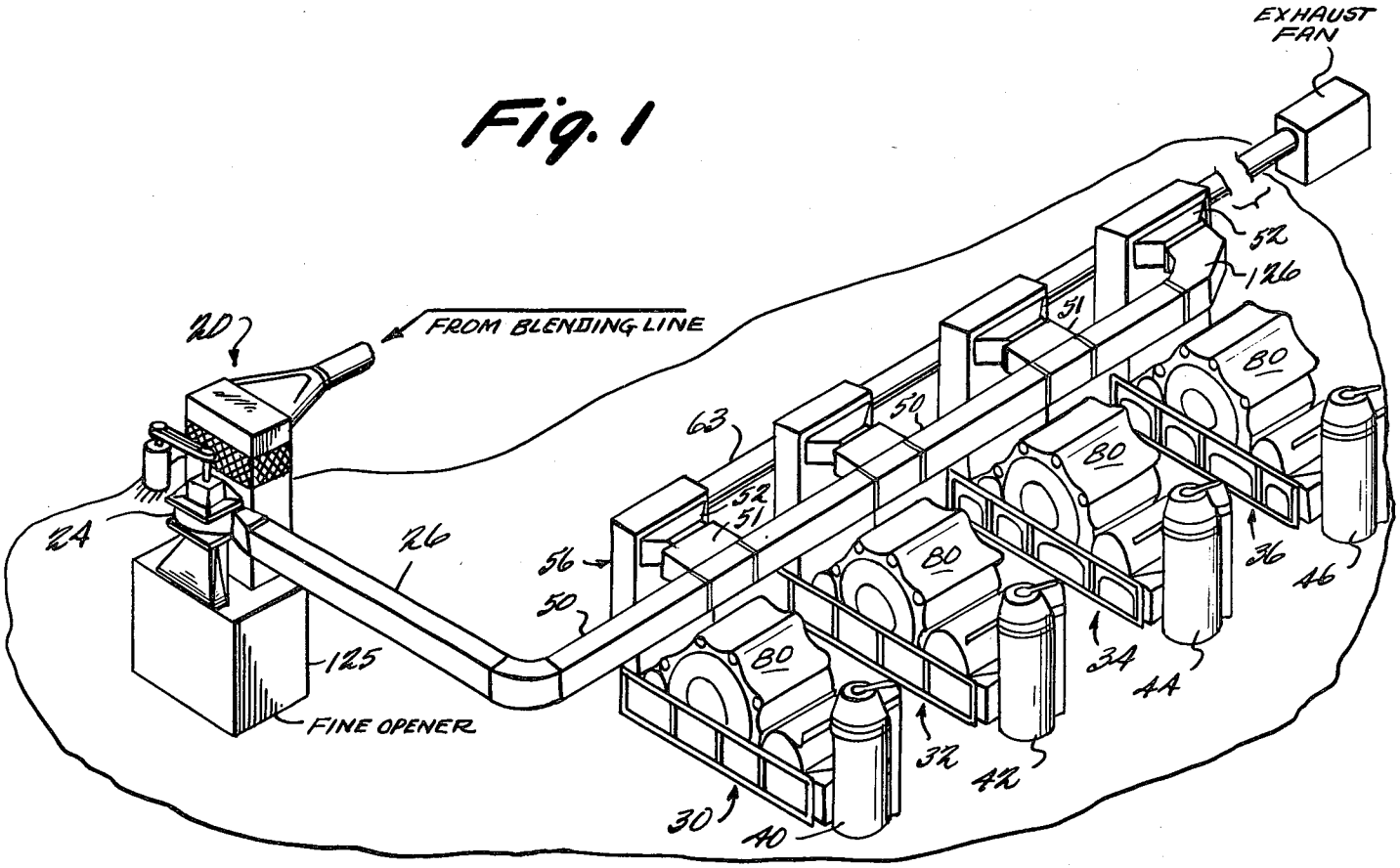

Reference is now made to FIG. 1 which illustrates an overall schematic view of a carding system. Fiber material such as relatively dense fibers, for example, pima cotton, nylon or bleached cotton from a blending line or the like are delivered to a fine opener assembly 20 which includes a fan or blower for producing positive air pressure, a conventional beater (not shown), and feed rolls for supplying fibers to the beater from a reserve sheet (not shown). The individual fibers from the blending line are entrained in a stream of air generated by blower 24 and passed within conduit 26 to a plurality of conventional card machines. In the system of FIG. 1, cards 30, 32, 34 and 36 together with associated coilers 40, 42, 44 and 46 are illustrated. It is, of course, understood that the system is not limited to any particular number of card machines and that the number of card machines can be adjusted in accordance with the desired output of the system and the amount of fiber which can be delivered by conduit 26 and the fine opener assembly 20. Suitable opener assemblies and blender lines are commercially available. One blending line, for example, is discussed and described in detail in U.S. Pat. No. 3,439,838.

Figure 2:
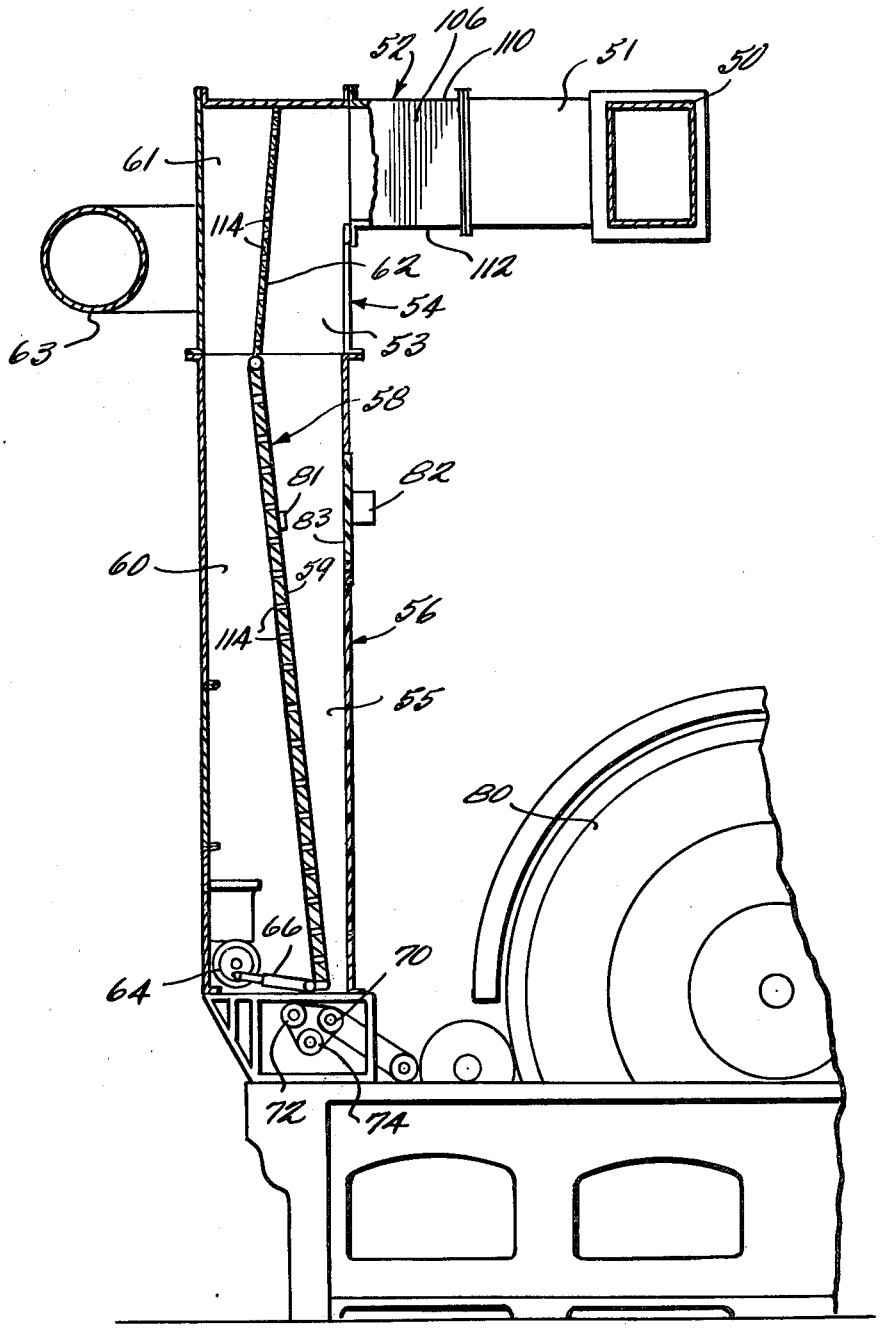
FIG. 2 shows a schematic view of a web former.

Reference is now made to FIG. 2 which illustrates a sectional view of a web former. The web former of FIG. 2 is generally similar to the web-former disclosed in U.S. Pat. No. 4,009,803 discussed above, and to the web former disclosed in Ser. No. 825,053, filed Aug. 16, 1977, now U.S. Pat. No. 4,155,485. The present invention differs from the web former of this latter application in the arrangement for controlling operation of the shaker plate. The disclosure of co-pending application Ser. No. 825,053 (U.S. Pat. No. 4,155,485) is hereby incorporated into the present application by reference.

An air stream with textile fibers entrained therein passes along conduit 50 which is mounted adjacent a number of the web-formers. As can be seen in FIG. 2, a valved passage 51 with a flared transition connects conduit 50 to a first or front chamber within the housing 56 of the web-former. That front chamber includes an upper section 53 in air box 54 and a lower section 55 in the shaker chute. A perforated plate 58 includes a lower shaker plate 59, which is oscillated about a pivot point at its upper end, and a fixed upper plate 62, the lower end of which is adjacent the pivot point of shaker plate 59. Perforated plates 59 and 62 divide the interior space into the above-mentioned front chamber and a second or rear chamber having a lower section 60 and an upper section 61. Fixed upper plate 62 passes much of the air, but deflects downward the entrained fibers which enter chamber 53 from conduit 50. Air still in the deflected fibers is squeezed out into the rear chamber section 60 by the oscillation of shaker plate 59. The air from section 60 and from the upper rear chamber section 61 is removed through an exhaust line 63 connected to an exhaust system (not shown). The deflected fibers separated from the air fall toward the bottom of chamber 55 where they are compacted into a web.

Shaker plate 59 is oscillated by a motor 64 eccentrically connected to the oscillating bottom portion of plate 59 by linkage 66. The compacted fibers which accumulate in chamber 55 are delivered therefrom as a web by rollers 70, 72, and 74 in a well-known fashion, to a conventional card 80. An electric control device 82 is mounted for detecting the level of fibers in the first chamber to prevent overfeeding of the same. Any suitable electrical or optical sensor can be used and several such devices are commercially available. Preferably device 82 is a combination light source and electric eye which receives reflections from mirror 81 through plastic portion 83. The electrical control is coupled to a conventional control circuit which controls operation of a flapper valve (not shown). The flapper valve is shifted between an open position and a closed position by means of a conventional piston. In the open position, the flap valve diverts flow of the air and entrained fibers into the flared transition passage.

Figure 4:
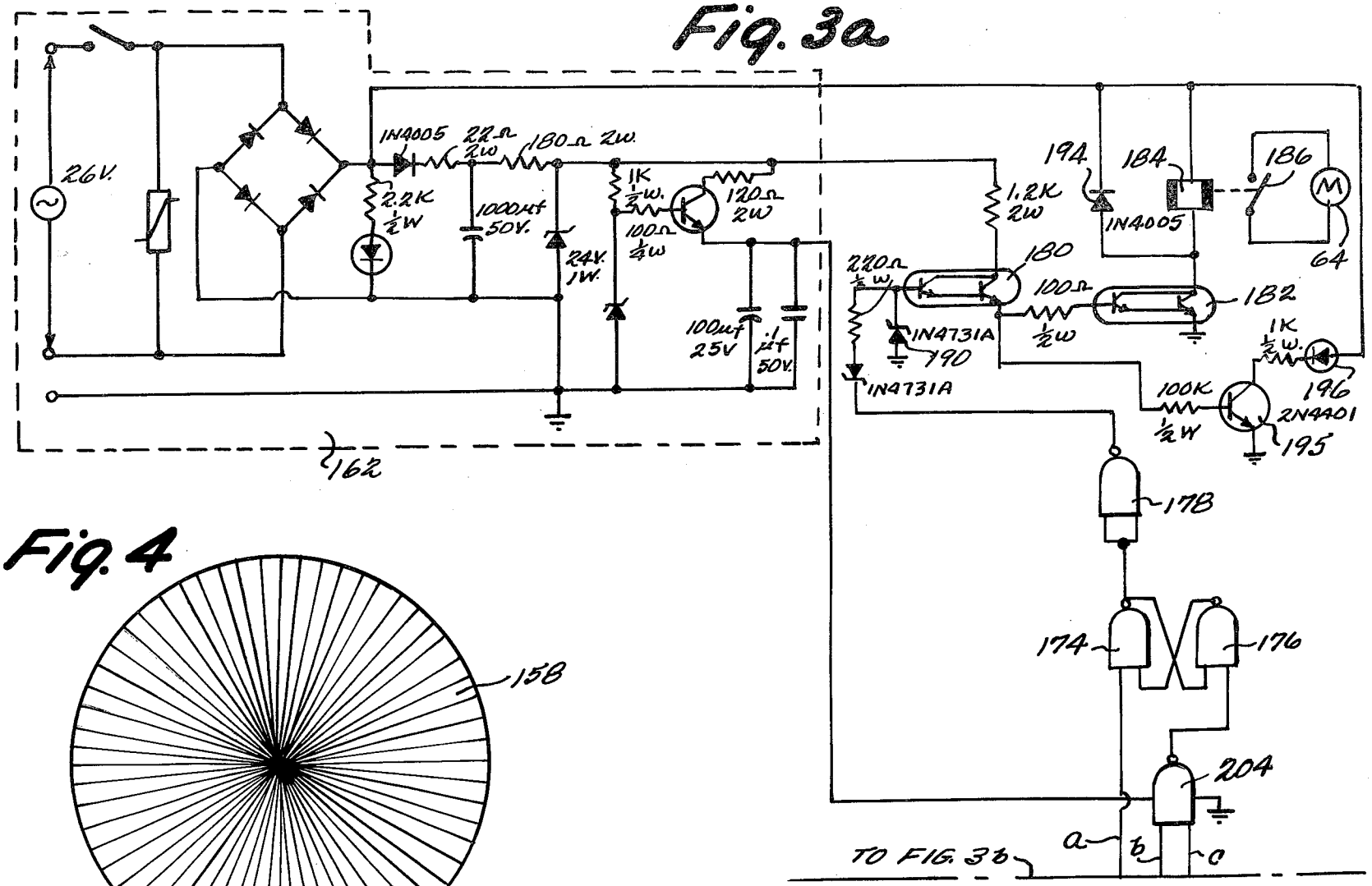
FIG. 4 shows a front view of the detecting disc.
Figure 4:
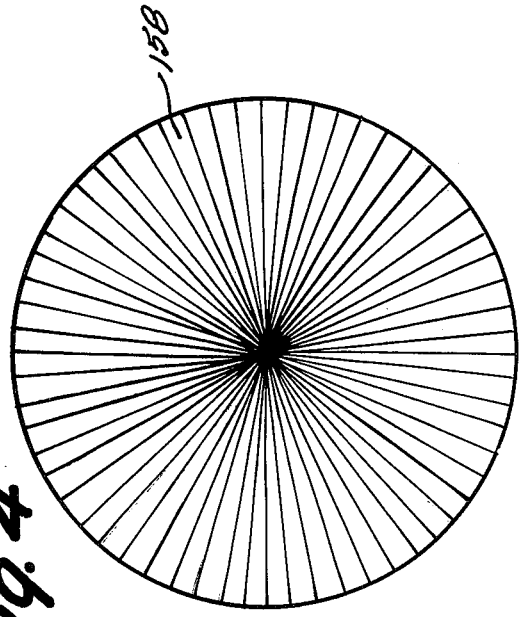
Figure 3B:
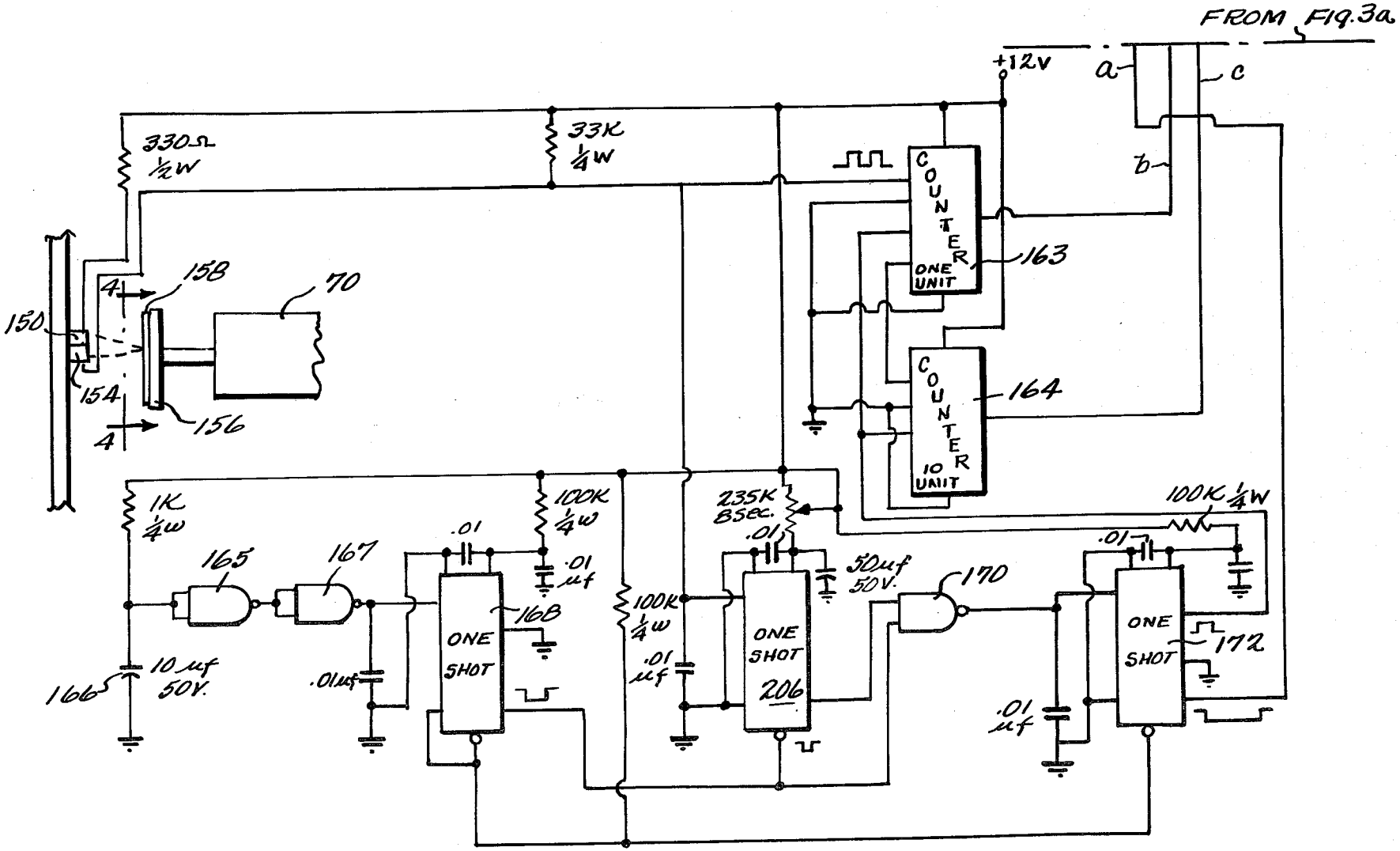

Reference is now made to FIGS. 3*a* and 3*b* which shows the circuitry of the present invention. Lamp 150 is an infra-red light emitting diode which is mounted in conjunction with phototransistor 154 so that phototransistor 154 produces a train of pulses as the roller 70 on which the light transmitting disc 156 and piece of film 158 are mounted is rotated under the control of the card, and the reflection light path is periodically broken by the bars. As shown in FIG. 4, film 158 is preferably a negative piece of film having radial black bars thereon and is stuck on plastic disc 156. The disc 156 and film 158 can be about three inches in diameter. Source 150 and phototransistor 154 can be, e.g., a sensor unit, such as sold by General Electric, under the trademark OPTOCOUPLER No. H13A1 or any other device. Source 150 and phototransistor 154 are shown schematically in FIG. 3*b* and it will be understood that they can be mounted in any suitable way.

When switch 160 is closed to initiate operation of the circuitry, regulated power supply 162 supplies A+12 volts to the control 172 and produces a pulse of +12 volts which is applied to the reset inputs of counters 163 and 164 to reset the same. The +12 volts supply charges capacitor 166. The positive transition is applied to the input of the inverter 165. The output of inverter 165 is again inverted by inverter 167 with the two inverters providing a slight delay. The pulse thus produced upon closing switch 160 triggers one shot multivibrator 168 which produces a short output pulse, e.g., of one millisecond which is applied to gate 170 which functions as an OR circuit, and which triggers one shot multivibrator 172 which in turn produces a first enabling output signal which is applied to gate 174. Gate 174 together with gate 176 constitutes a logic circuit, namely, a flip-flop circuit functioning as a latch. The pulse thus applied to gate 174 drives the output of the latch high. That high output is inverted by gate 178 and applied to emitter follower circuit 180 to turn off the emitter follower circuit which consequently turns off emitter follower circuit 182 and prevents current from flowing through relay coil 184 which controls switch 186 which in turn controls the three-phase magnetic switches of motor 64. Zener diode 190 holds the emitter follower circuit 180 to 3.6 volts. Diode 194 protects against transients produced during switching. Transistor 195 controls the flow of current through light emitting diode 196 which serves as an indicator of the status of the relay and as to whether the motor is operating. Thus, when the switch 160 is initially closed, both the counters 163 and 164 are reset and the latch comprising gates 174 and 176 is similarly reset to an off position.

The pulses which are received from the photo-transistor 154 are now counted by the counter circuit comprising individual counter units 163 and 164. When these counter units have counted to a predetermined number, e.g., 99, the output of gate 204 produces a second enabling signal and sets the latch comprising gates 174 and 176 with the result that transistor circuits 180 and 182 are rendered conductive and current flows through coil 184 to cause motor 188 to begin operation. Each of the pulses produced by phototransistor 154 is applied to the one-shot multivibrator 206, which in turn produces an output which is kept low.

If the one-shot multivibrator 206 should time out, then the output of gate 170 causes the one-shot multivibrator 172 to produce an output which in turn resets the latch comprising gates 174 and 176 to immediately turn off the motor 64 as described above with regard to the initial setting of the circuitry.

Many changes and modifications can be made without departing from the scope of the invention, such scope intended to be limited only by the scope of the appended claims.

What is claimed is:

1. A web former for removing fibers from a conduit carrying a stream of air with textile fibers entrained therein and forming a web of said fibers;

a housing having an interior space;

a perforated plate with at least a portion mounted for oscillatory movement and dividing said interior space into a first chamber and a second chamber;

means defining a passage between said conduit and said first chamber so that air with textile fibers therein passes into said first chamber and the air then into said second chamber through said perforated plate leaving the fibers in said first chamber;

means for oscillating at least a portion of said plate;

a plurality of rollers at the bottom of said first chamber;

means for rotating said rollers to form a web of textile material;

optical means mounted adjacent one of said rollers for detecting rotation of that roller and producing a train of electrical pulses when that roller is rotating;

circuit means for controlling said oscillating means to stop oscillation following cessation of said pulses and to begin oscillation after a predetermined delay following beginning of said pulses, said circuit means including switch means connected to said oscillating means, having a first position supplying power to said oscillating means and a second position interrupting the supply of power to said oscillating means, means connected to said detecting and producing means for producing a first enabling signal in response to said pulses, counter means for counting said pulses and producing a second enabling signal upon a given count, and logic means connecting said counter means and said detecting and producing means to said switch means for producing a first output causing said switch means to shift to said first position when said counter means produces said second enabling signal and said detecting and producing means produces said first enabling signal and for shifting to said second position when said detecting and producing means ceases producing said first enabling signal.

2. A web former as in claim 1, wherein said detecting means includes a disc mounted on said one roller for rotation therewith and having a plurality of bars thereon separated by areas having different optical transmission, a light source and a light responsive element, said source and element being mounted with respect to each other so that light from said source to said element is periodically interrupted during rotation of said disc.

3. A web former as in claim 2, wherein said bars are formed radially and number about sixty.

4. A web former as in claim 2, wherein said disc includes a plastic, light transmitting member with a piece of film thereon, said film having said bars formed thereon.

5. A web former as in claim 1, wherein said first enabling signal producing means includes a one shot multivibrator circuit for producing a second enabling signal having a predetermined duration upon receipt of a pulse, said enabling signal continuing until said predetermined duration after receipt of the last pulse and for producing a reset signal when said enabling signal is produced for resetting said counter means.

6. A web former as in claim 1, including a source of electrical energy for supplying power to said circuit means, power switch means for connecting and disconnecting said source to and from said circuit means and means connected to said source for causing said multivibrator to produce said second enabling signal upon connection of said source to said circuit means by said power switch means.

7. A web former as in claim 1, wherein said plate oscillating means includes a motor and said switch means includes a relay having a controlled switch connected to said motor.

8. A web former as in claim 1, wherein said logic means includes first and second logic gates interconnected to form a flip-flop.

* * * * *